US007344418B2

(12) United States Patent
Xu

(10) Patent No.: US 7,344,418 B2
(45) Date of Patent: Mar. 18, 2008

(54) ELECTRICAL TERMINAL

(75) Inventor: Xiang Xu, Kuns Han (CN)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/579,326

(22) PCT Filed: Nov. 19, 2004

(86) PCT No.: PCT/US2004/039084

§ 371 (c)(1),
(2), (4) Date: Feb. 8, 2007

(87) PCT Pub. No.: WO2005/053369

PCT Pub. Date: Jun. 9, 2005

(65) Prior Publication Data

US 2007/0134995 A1 Jun. 14, 2007

(30) Foreign Application Priority Data

Nov. 20, 2003 (CN) ..... 20100684

(51) Int. Cl.
*H01R 13/24* (2006.01)

(52) U.S. Cl. ..... 439/700; 439/824

(58) Field of Classification Search ..... 439/66, 439/700, 824

See application file for complete search history.

(56) References Cited

U.S. PATENT DOCUMENTS 6,350,155 B1 * 2/2002 Mullinger-Bausch et al. ..... 439/675
6,464,511 B1 * 10/2002 Watanabe et al. ..... 439/66
6,685,492 B2 * 2/2004 Winter et al. ..... 439/219
6,758,682 B1 * 7/2004 Kosmala ..... 439/66
6,773,312 B2 * 8/2004 Bauer et al. ..... 439/824
6,861,862 B1 * 3/2005 Tate ..... 324/761
6,902,410 B2 * 6/2005 Watanabe ..... 439/66
6,957,986 B2 * 10/2005 Jing ..... 439/700
7,114,996 B2 * 10/2006 Goodman et al. ..... 439/700
7,154,286 B1 * 12/2006 Marx et al. ..... 324/761
2003/0176113 A1 * 9/2003 Sasaki ..... 439/700
2004/0005791 A1 * 1/2004 Sato et al. ..... 439/66
2004/0043641 A1 * 3/2004 Kosmala ..... 439/66
2004/0053539 A1 * 3/2004 Watanabe ..... 439/700
2004/0077225 A1 * 4/2004 Chun-Fu ..... 439/700
2004/0127106 A1 * 7/2004 Sekiguchi ..... 439/700
2004/0137800 A1 * 7/2004 Jing ..... 439/700
2004/0161981 A1 * 8/2004 Matsui et al. ..... 439/824

(Continued)

*Primary Examiner*—Ross Gushi
(74) *Attorney, Agent, or Firm*—Charles S. Cohen

(57) ABSTRACT

An electrical terminal (30) includes a first contact member (32) having an outer pressure contacting end portion (32*a*) of a given diameter for pressure engaging a first electrical device. The first contact member has an inner end portion (32*b*) of a diameter at least slightly larger than the given diameter of the outer end portion. A second contact member (34) has a front pressure contacting end (34*a*) for pressure engaging a second electrical device. The second contact member has a rear end (34*b*) with a hole (38) for reciprocally receiving the inner end portion (32*b*) of the first contact member (32). A restricted stop is formed at the rear (34*b*) end of the hole (38) for abutting the inner end portion of the first contact member to define an outer limit position of the first contact member. A biasing member (36) is disposed in the hole in the second contact member and is engageable with the inner end portion of the first contact member. The biasing member resiliently biases the first and second contact members in opposite directions.

11 Claims, 3 Drawing Sheets

U.S. PATENT DOCUMENTS

2004/0224570 A1* 11/2004 Yeh ..... 439/824
2004/0266272 A1* 12/2004 Maruyama et al. ..... 439/700
2005/0026510 A1* 2/2005 Orihara ..... 439/700
2005/0202729 A1* 9/2005 Hatanaka ..... 439/700
2005/0227546 A1* 10/2005 Sekiguchi ..... 439/700
2005/0266734 A1* 12/2005 Kazama ..... 439/700
2006/0172613 A1* 8/2006 Sasaki ..... 439/824
2007/0224889 A1* 9/2007 Ito ..... 439/824

* cited by examiner

ELECTRICAL TERMINAL

FIELD OF THE INVENTION

This invention generally relates to the art of electrical connectors and, particularly, to a double-ended electrical terminal for pressure-engagement between a pair of electrical devices.

BACKGROUND OF THE INVENTION

FIG. 1A shows a conductive electrical terminal, generally designated 10, which can be used in electrical connectors, testing probes or the like, according to the prior art. The terminal is an assembly which includes a conductive housing 12, a contact member 14 and a coil spring 16. The contact member has a reduced-diameter front end 14*a* and an enlarged rear end 14*b*. The housing has an inner wall 12*a* within which the enlarged rear end of the contact member is slidably disposed. The housing also has an open front end 12*b* and a closed rear end 12*c*. Coil spring 16 is sandwiched or "loaded" between closed rear end 12*c* of the housing and rear end 14*b* of the contact member to bias the contact member forwardly as shown in FIG. 1. The closed end of the housing or terminal is fixed to an electrical device by soldering, and front end 14*a* of the contact member pressure engages a second electrical device, whereby terminal 10 electrically couples the two electrical devices. Therefore, the prior art terminal 10 of FIG. 1A has a fixed end and only one pressure contacting end or function.

Another prior art pressure engaging terminal is shown in FIG. 1B and is generally designated 20. The terminal includes a housing 22, a first contact member 24, a second contact member 26 and a coil spring 28. Contact member 24 has a reduced-diameter outer end 24*a* and an enlarged inner end 24*b*. Contact member 26 has a reduced-diameter outer end 26*a* and an enlarged inner end 26*b*. Housing 22 has an opening 22*a* at one end thereof through which the outer end 24*a* of contact member 24 projects. The housing has an opening 22*b* at the opposite end thereof through which outer end 26*a* of terminal 26 projects. The housing may be fabricated of dielectric material and include a bore 22*c* extending between and communicating with openings 22*a* and 22*b*. The bore is lined with a conductive inner tube 29 which defines a through hole 29*a* within which the enlarged rear ends 24*b* and 26*b* of contact members 24 and 26, respectively, are slidably disposed. Coil spring 28 preferably is of conductive metal material and is effective to bias contact members 24 and 26 in opposite directions for making pressure contacting engagement between a pair of electrical devices.

Whereas prior art terminal 10 in FIG. 1A has a single pressure contacting end or function, prior art terminal 20 in FIG. 1B has two opposite pressure contacting ends or functions. However, both terminals require separate housings. Housing 12 of terminal 10 is fabricated of conductive metal material and the open end of the housing (at opening 12*b*) must be riveted or bent about contact member 14 during assembly. Housing 22 of prior art terminal 20 creates additional problems of assembling contact members 24 and 26 within the housing. If the housing is fabricated of dielectric material, the opposite ends of the housing are difficult to precisely mold about the contact members. If the housing is fabricated of conductive metal material, the multiple riveting or bending processes are not cost effective. The present invention is directed to solving these problems and providing improvements in such electrical terminals, particularly in providing an extremely simple electrical terminal having pressure engaging contact members or functions at opposite ends thereof.

SUMMARY OF THE INVENTION

An object, therefore, of the invention is to provide a new and improved electrical terminal of the character described.

In the exemplary embodiment of the invention, the terminal includes a first contact member having an outer pressure contacting end portion of a given diameter for pressure engaging a first electrical device. The first contact member has an inner end portion of a diameter at least slightly larger than the given diameter of the outer end portion. A second contact member has a front pressure contacting end for pressure engaging a second electrical device. The second contact member has a rear end formed with a hole for reciprocally receiving the inner end portion of the first contact member. A restricted stop is formed at the rear end of the hole for abutting the inner end portion of the first contact member to define an outer limit position of the first contact member. A biasing member is disposed in the hole in the second contact member and is engageable with the inner end portion of the first contact member. The biasing member resiliently biases the first and second contact members in opposite directions. This terminal construction completely eliminates the housings of the prior art.

As disclosed herein, the outer pressure contacting end portions of the first and second contact members are dome shaped to present rounded convex contact surfaces for engaging the two electrical devices. The biasing member is a coil spring having opposite ends engageable with the inner end portion of the first contact member. Preferably, the inner end portion of the first contact member and the hole in the second member are circular in cross-section.

According to one aspect of the invention, the second contact member includes an outwardly projecting bearing flange for reciprocally engaging a bearing surface on the second electrical device. In the exemplary embodiment, the bearing flange comprises a peripheral bearing ring about the second contact member. The bearing ring is located near the rear end of the second contact member.

According to another aspect of the invention, a second electrical device is provided and includes a housing having a mounting cavity with a fixed contact at a base of the cavity. The rear end of the second contact member is reciprocally mounted in the cavity, with the bearing ring slidably engageable with the inner walls of the cavity. The pressure contacting end portion of the first contact member is biased into engagement with the fixed contact at the base of the cavity. The pressure contacting end of the second contact member projects from the housing. The cavity has a restricted stop at an open end thereof for abutting the bearing ring to define an outer limit position of the second contact member projecting from the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1A:
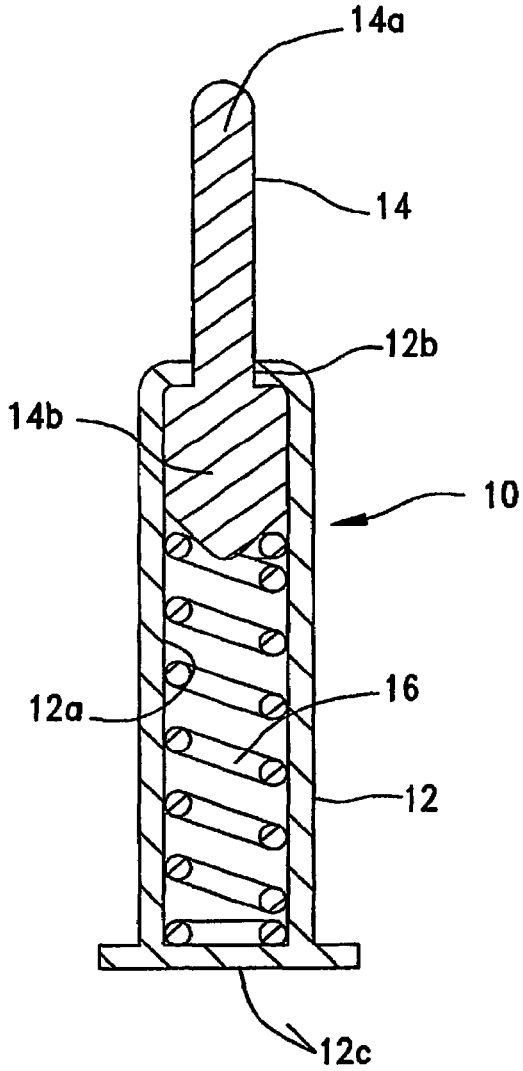
FIG. 1A (PRIOR ART)
FIGS. 1A and 1B are longitudinal sectional views through prior art terminals as described in the Background, above.
Figure 1B:
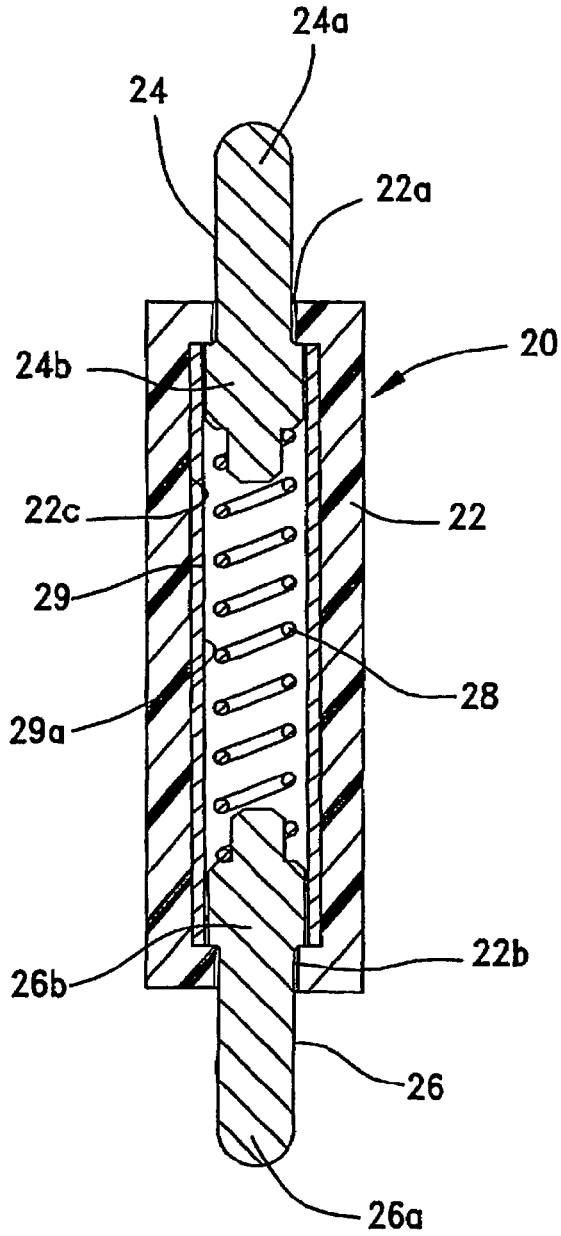
FIG. 1B (PRIOR ART)
Figure 2:
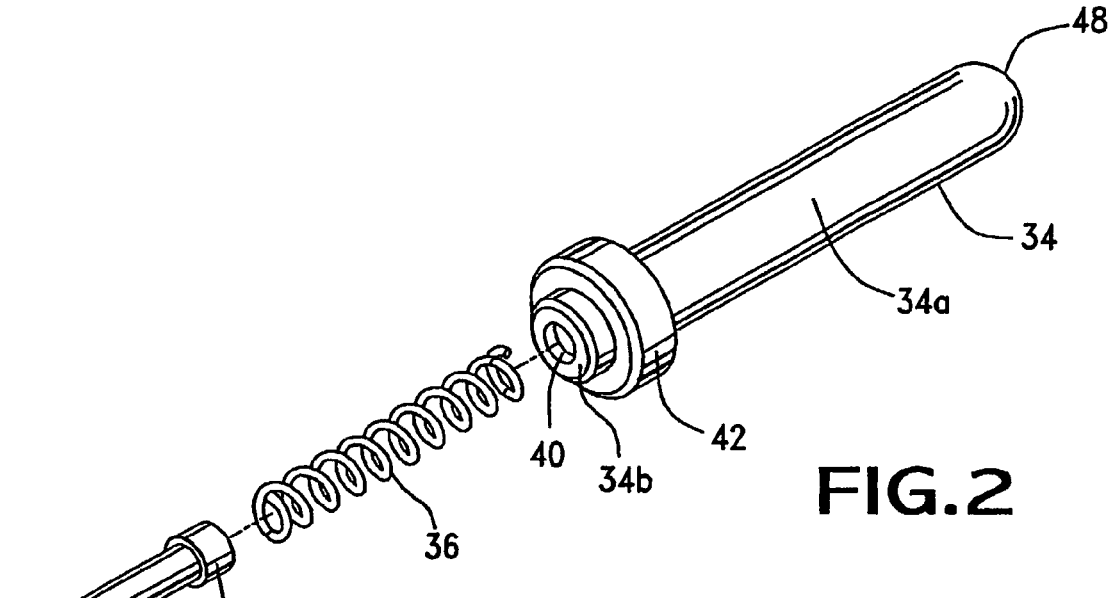
FIG. 2 is an exploded perspective view of an electrical terminal according to the invention.
Figure 3:
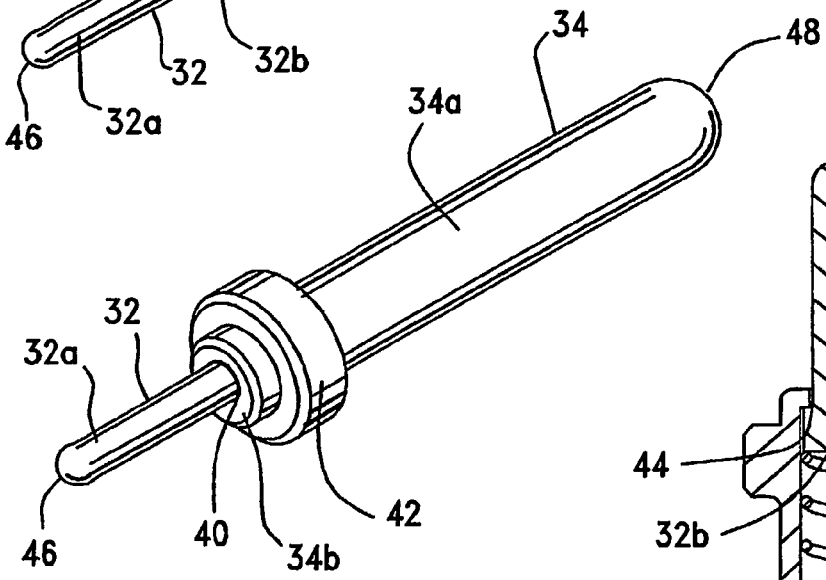
FIG. 3 is a perspective view of the terminal of FIG. 1 in assembled condition.
Figure 4:
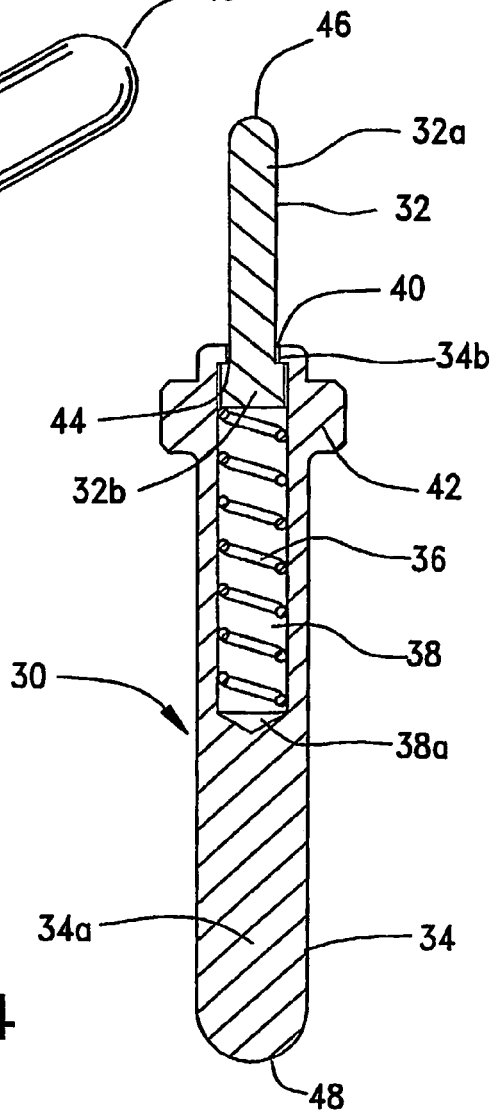
FIG. 4 is a longitudinal or axial section through the terminal.

Referring to the drawings in greater detail, and first to FIGS. 2-4, the invention is embodied in a double-ended pressure-contacting electrical terminal, generally designated 30. The terminal is extremely simple and includes only three components, namely: a first contact member 32, a second contact member 34 and a biasing member in the form of a coil spring 36. The contact members are fabricated of conductive material such as metal.

First contact member 32 includes an elongated, outer pressure contacting end portion 32*a* of a given diameter for pressure engaging a first electrical device as described hereinafter. The first contact member includes an inner end portion 32*b* of a diameter larger than the given diameter of outer end portion 32*a*.

Second contact member 34 has an elongated, front pressure contacting end 34*a* for pressure engaging a second electrical device as described hereinafter. A rear end 34*b* of the second contact member has a cylindrical hole 38 for reciprocally receiving the inner end portion 32*b* of first contact member 32, while outer end portion 32*a* of the first contact member extends through an opening 40 at the rear end of the second contact member. Coil spring 36 is compressed between inner end portion 32*b* of the first contact member and a bottom or base 38*a* of cylindrical hole 38 in the second contact member to bias the outer end portion 32*a* of the first contact member outwardly relative to the second contact member. Finally, the second contact member is provided or formed with an outwardly projecting bearing flange 42 which extends completely around the second contact member to form a peripheral bearing ring for purposes described hereinafter. The bearing ring is located near the rear end 34*b* of the second contact member.

During assembly, coil spring 36 first is inserted into cylindrical hole 38 in second contact member 34. The enlarged inner end portion 32*b* of first contact member 32 then is assembled into the hole on top of the coil spring to compress the spring. Rear end 34*b* of the second contact member then is riveted or bent to capture the inner end portion 32*b* of the first contact member within the rear end of the second contact member within the rear end of cylindrical hole 38. The riveting or bending of rear end 34*b* of the second contact member defines a circular restricted stop 44 at the rear end of hole 38 for abutting the inner end portion 32*b* of the first contact member to define an outer limit position of the outer end portion 32*a* of the first contact member.

As can be seen in the drawings, outer end portion 32*a* of first contact member 32 and front end 34*a* of second contact member 34 are dome shaped to present rounded convex contact surfaces 46 for the first contact member and 48 for the second contact member, for engaging appropriate electrical devices as shown hereinafter. Preferably, the inner end portion 32*b* of first contact member 32 as well as hole 38 in the second contact member are circular in cross-section.

Figure 5:
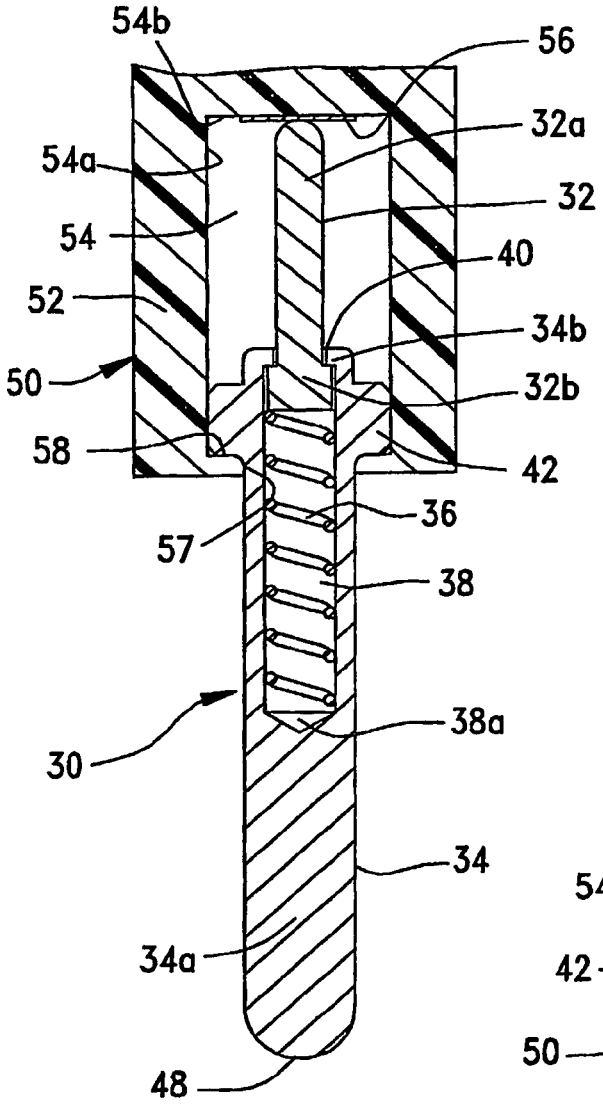
FIG. 5 is a view similar to that of FIG. 4, with the terminal mounted in a housing of an electrical device.

Referring to FIG. 5, terminal 30 is shown assembled to a first electrical device, generally designated 50. The first electrical device includes a housing 52 having a mounting cavity 54 defined by inner walls 54*a*. A fixed contact 56 is fixed to a base 54*b* of the mounting cavity. The housing has an opening 57 communicating with the cavity, and a restricted stop 58 is formed about the opening at the interior of the cavity.

When terminal 30 is mounted in first electrical device 50, rear end 34*b* of second contact member 34 is reciprocally mounted within mounting cavity 54 of housing 52 of the first electrical device, with bearing ring 42 slidably engageable with inner walls 54*a* of cavity 54. Pressure contacting end portion 32*a* of first contact member 32 is biased by coil spring 36 into engagement with fixed contact 56 at base 54*b* of the cavity. The pressure contacting end 34*a* of second contact member 34 projects through opening 56 and from housing 52. Restricted stop 58 at opening 57 of housing 52 abuttingly engages bearing ring 42 to define an outer limit position of second contact member 34 projecting from housing 52, as seen in FIG. 5.

Figure 6:
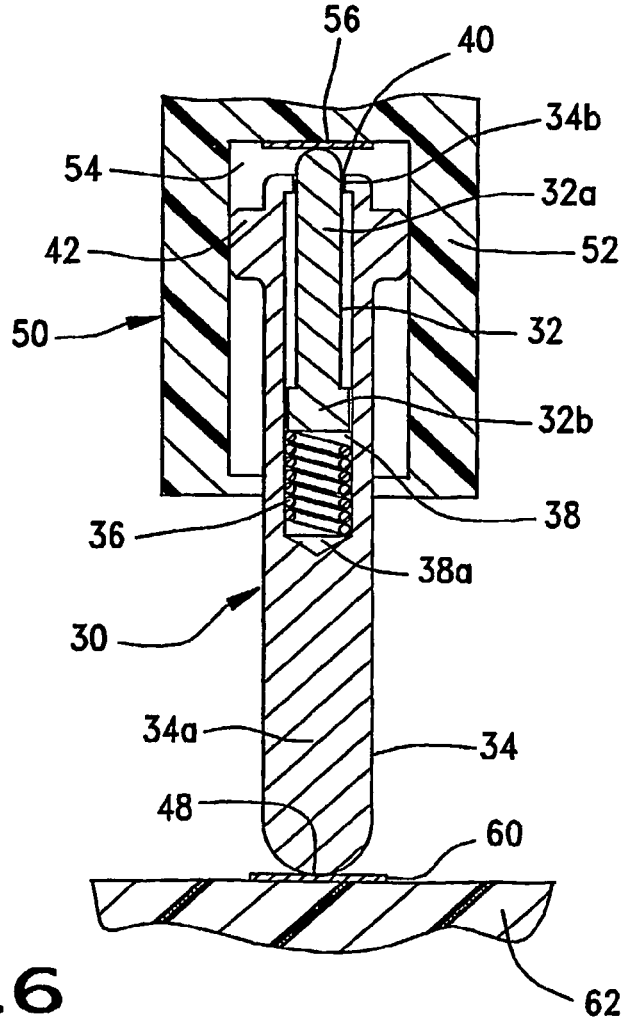
FIG. 6 is a view similar to that of FIG. 5, with the terminal sandwich between the electrical device of FIG. 5 and a second electrical device.

FIG. 6 shows terminal 30 mounted within housing 52 of first electrical device 50, as described above in relation to FIG. 5, and with second contact member 34 of the terminal engaging a fixed contact 60 of a second electrical device 62. It can be seen that second contact member 34 has been pushed inwardly into mounting cavity 54 of first electrical device 50, in the direction of arrow "A". This compresses coil spring 36 which, in turn, biases the first and second contact members 32 and 34, respectively, in opposite directions into pressure contacting engagement with fixed contacts 56 and 60, respectively, of the first and second electrical devices 50 and 62, respectively. Therefore, the simple construction of the two inter-mounted contact members 32 and 34 are effective to electrically couple the two fixed contacts of the two electrical devices without the use of any extraneous housings whatsoever.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical terminal (30), for mounting in a mounting cavity (54) in a fuirst electrical device (50) with one open end (57) comprising:

a first contact member (32) having an outer pressure contacting end portion (32*a*) of a given diameter for pressure engaging a first electrical device (50) and an inner end portion (32*b*) of a diameter at least slightly larger than said given diameter;

a second contact member (34) having a front pressure contacting end (34*a*) for pressure engaging a second electrical device (62), a rear end (34*b*) having a hole (38) for reciprocally receiving the inner end portion of the first contact member, a restricted stop (44) at the rear end of the hole for abutting the inner end portion of the first contact member to define an outer limit position of the first contact member, an outwardly projecting bearing flange (42) for reciprocally engaging a bearing surface (54*a*) on the first electrical device (50);

a biasing member (36) in said hole in the second contact member and engageable with the inner end portion of the first contact member for resiliently biasing the first and second contact members in opposite directions; and the first electrical device (50) having a housing (52) with the enclosed mounting cavity (54), the mounting cavity with a fixed contact (56) at a base (54*b*) of the cavity opposite said open end (57), the rear end (34*b*) of the second contact member (34) being reciprocally mounted in the cavity with said bearing ring (42) slidably engageable with inner walls (54*a*) of the cavity, the pressure contacting end portion (32*a*) of the first contact member (32) being biased into engagement with the fixed contact at the base of the cavity, the pressure contacting end (34*a*) of the second contact member (34) projecting from the housing, and the cavity has a restricted stop (58) at an open end (57) thereof for abutting the bearing ring to define an outer limit position of the second contact member projecting from the housing.

2. The electrical terminal of claim 1 wherein the outer pressure contacting end portion (32*a*) of said first contact member (32) is dome shaped to present a rounded convex contact surface (46) for engaging the first electrical device (50).

3. The electrical terminal of claim 1 wherein said biasing member comprises a coil spring (36) having one end engageable with the inner end portion (32*b*) of the first contact member (32) and an opposite end engageable with a bottom (38*a*) of the bole (38).

4. The electrical terminal of claim 1 wherein said inner end portion (32*b*) of the first contact member (32) and said hole (38) in the second contact member (34) are circular in cross-section.

5. The electrical terminal of claim 1 wherein the outer pressure contacting end (34*a*) of said second contact member (34) is dome shaped to present a rounded convex contact surface (46) for engaging the second electrical device (62).

6. The electrical terminal of claim 5 wherein the outer pressure contacting end portion (32*a*) of said first contact member (32) is dome shaped to present a rounded convex contact surface (46) for engaging the first electrical device (50).

7. The electrical terminal of claim 1 wherein said bearing flange comprises a peripheral bearing ring (42) about the second contact member (34).

8. The electrical terminal of claim 7 wherein said bearing ring (42) is located near the rear end (34*b*) of the second contact member (34).

9. An electrical terminal (30) for mounting in an enclosed mounting cavity (54) in a first electrical device (50) with one open end (57), comprising;

a first contact member (32) having an outer pressure contacting end portion (32*a*) of a given diameter for pressure engaging a first electrical device (50) and an inner end portion (32*b*) of a diameter at least slightly larger than said given diameter, the outer pressure contacting end portion being dome shaped to present a rounded convex contact surface (46) for the first electrical device;

a second contact member (34) having a front pressure contacting end (34*a*) for pressure engaging a second electrical device (62), a rear end (34*b*) having a hole (38) for reciprocally receiving the inner end portion of the first contact member, and a restricted stop (44) at the rear end of the hole for abutting the inner end portion of the first contact member to define an outer limit position of the first contact member, the outer pressure contacting end being dome shaped to present a rounded convex contact surface (48) for engaging the second electrical device;

said inner end portion (32*b*) of the first contact member (32) and said hole (38) in the second contact member (34) being circular in cross-section;

a coil spring (36) in said hole (38) in the second contact member and engageable with the inner end portion of the first contact member for resiliently biasing the first and second contact members in opposite directions; and said first electrical device (50) including a housing (52) having the enclosed mounting cavity (54) with a fixed contact (56) at a base (54*b*) of the cavity opposite the open end (57), the rear end (34*b*) of the second contact member (34) being reciprocally mounted in the cavity with a bearing flange (42) slidably engageable with inner walls (54*a*) of the cavity, the pressure contacting end portion (32*a*) of the first contact member (32) being biased into engagement with the fixed contact at the base of the cavity, the pressure contacting end (34*a*) of the second contact member (34) projecting from the housing, and the cavity has a restricted stop (58) at an open end (57) thereof for abutting the bearing flange to define an outer limit position of the second contact member projecting from the housing.

10. The electrical terminal of claim 9 wherein said bearing flange comprises a peripheral bearing ring (42) about the second contact member (34).

11. The electrical terminal of claim 10 wherein said bearing ring (42) is located near the rear end (34*b*) of the second contact member (34).

* * * * *